US007617815B2

(12) United States Patent
Wey

(10) Patent No.: US 7,617,815 B2
(45) Date of Patent: Nov. 17, 2009

(54) FUEL ACTIVATOR USING MULTIPLE INFRARED WAVELENGTHS

(76) Inventor: Albert Chin-Tang Wey, 233 E. 57th St., Westmont, IL (US) 60559-2080

( * ) Notice: Subject to any disclaimer, the term of this patent is extended or adjusted under 35 U.S.C. 154(b) by 28 days.

(21) Appl. No.: 11/983,881

(22) Filed: Nov. 13, 2007

(65) Prior Publication Data

US 2009/0120416 A1 May 14, 2009

(51) Int. Cl.
*F02M 27/00* (2006.01)

(52) U.S. Cl. ..... 123/538

(58) Field of Classification Search ..... 123/536–538
See application file for complete search history.

(56) References Cited

U.S. PATENT DOCUMENTS 6,026,788 A 2/2000 Wey
6,082,339 A 7/2000 Wey
7,021,297 B1 4/2006 Slingo
7,036,492 B2 5/2006 Yoshimoto
7,281,526 B2 10/2007 Keiichiro et al.
2006/0011176 A1 * 1/2006 Wey ..... 123/538

* cited by examiner

*Primary Examiner*—Marguerite J McMahon
(74) *Attorney, Agent, or Firm*—Patzik, Frank & Samotny Ltd.

(57) ABSTRACT

This invention relates to a fuel activating device and method consisting of at least two separate infrared-emitting bodies, each infrared-emitting body being engineered to have specific peak wavelength and spectral luminance in 3-20 um (micrometer) wavelength range, that provides an effective means for enhancing combustion of hydrocarbon fuels in internal combustion engines, resulting in better engine performance with increased power, improved fuel economy, and reduced emissions.

13 Claims, 1 Drawing Sheet

FUEL ACTIVATOR USING MULTIPLE INFRARED WAVELENGTHS

BACKGROUND

1. Field of Invention

Figure 1:
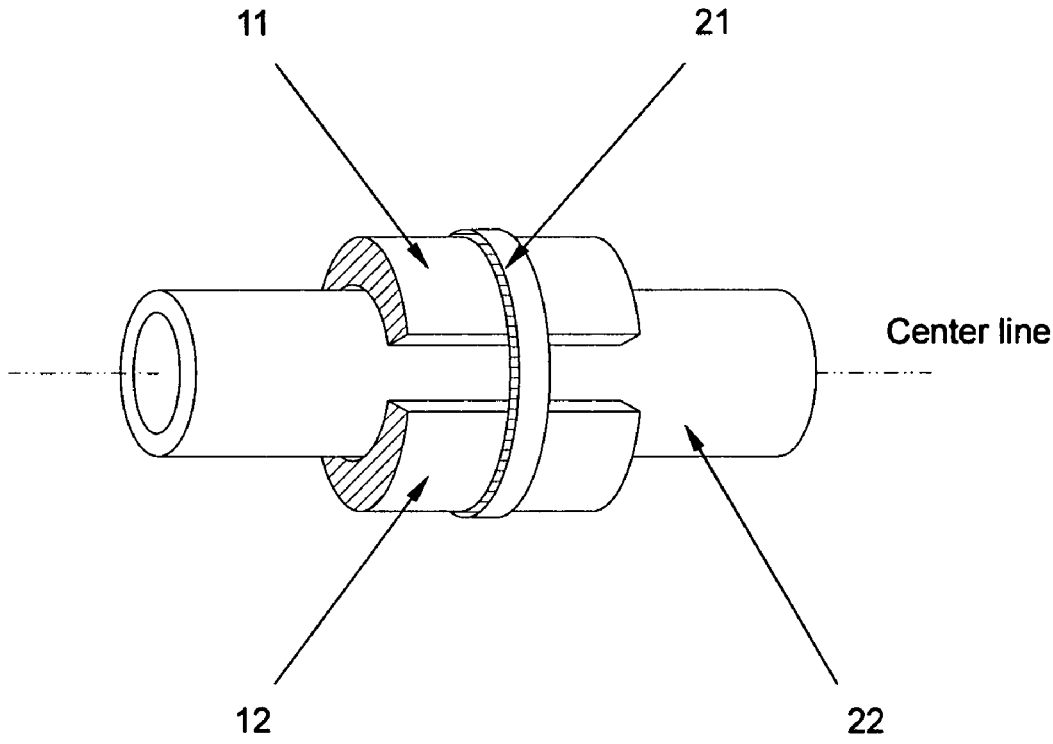

This invention relates to a fuel activating device and method consisting of at least two separate infrared-emitting bodies, each infrared-emitting body being engineered to have specific peak wavelength and spectral luminance in 3-20 um (micrometer) wavelength range, that provides an effective means for enhancing combustion of hydrocarbon fuels in internal combustion engines, resulting in better engine performance with increased power, improved fuel economy, and reduced emissions.

2. Description of Prior Art

According to Organic Chemistry, photoexciting hydrocarbons with infrared photons shorter than 20 um in wavelengths for enhanced fuel conversion efficiency were believed to be scientifically predictable. After years of research the present inventor had discovered the use of infrared radiation at 3-14 um wavelengths, which are categorized as "mid-infrared" by U.S. NASA but as "far-infrared" in Japanese convention, for improving combustion efficiency of hydrocarbon fuel in internal combustion engines that resulted in inventions of fuel combustion enhancement devices as disclosed in U.S. Pat. Nos. 6,026,788 and 6,082,339 by the present inventor. Since then, a number of inventions in this field followed, for example U.S. Pat. Nos. 7,021,297, 7,036,492, and 7,281,526 just to name a few.

Although the device as described in U.S. Pat. No. 6,026,788 by the present inventor worked adequately, the fuel activation effect became limited in the applications for heavy duty gasoline or diesel trucks due to the fact that these applications required irradiating a large flow of fuel substance in a very short time interval. Besides, commercial fuels comprise a very complex hydrocarbon system that contains a wide variety of hydrocarbons and absorb infrared photons all over the entire 3-20 um wavelength spectrum.

In Organic Chemistry, hydrocarbons absorb assorted infrared photons in 3-20 um wavelengths causing molecular vibrations. The present inventor has experimentally verified in laboratory that increasing molecular vibrations can result in lowered activation barrier of hydrocarbon molecules and thus increase fuel's combustibility with amplified oxidation rate in combustion. However, as stated before, the multiple-component hydrocarbons in commercial fuel systems require absorbing photons with wavelengths spanning all through the 3-20 um wavelength range so that it requires uniform emissions over the said spectrum to effectively excite all hydrocarbon components in the fuel systems.

Unfortunately, regardless of endless trials, the present inventor found it would be difficult to design a broadband infrared emitter that could uniformly distribute the radiation energy over the entire 3-20 um spectrum. In theory, most of the available radiation energy from such IR-emitter is often associated with short wavelengths (i.e. high frequencies). Moreover, the peak wavelength where the maximum flux density per unit wavelength interval emerging from IR-emitter will displace toward short wavelength as temperature increases, known as Wien's Displacement Law. This inevitably results in radiation energy being over-strengthened in short wavelengths but weakened in long wavelengths, which may leave some groups of hydrocarbons in the fuel unexcited or less-excited and reduce the overall infrared activation effect on the fuel.

The devices as described in U.S. Pat. No. 6,026,788 by the present inventor used an infrared emitting body composed of metal oxides selected from the groups consisting alumina, silica, zirconia, lithium oxide, magnesium oxide, calcium oxide, titanium oxide, and so on. After the mixture of purposely selected oxides and bonding agent had been sintered at a temperature above 1200° C., the characteristic infrared spectral luminance became specific and permanent. The profile of spectral radiation rate of such IR-emitter can be preset only by carefully choosing the composition of oxides and processing parameters during fabrication. As such, IR-emitters with specific peak wavelength and spectral luminance profile in the desired 3-20 um wavelength range can be deliberately made.

Accordingly, the present inventor had tailored IR-emissions at specific peak wavelengths in 3-20 um range by precisely controlling weight percentages of key elements such as zirconia, magnesium oxide, and cobalt oxide in the oxide mixture. In laboratory, the peak wavelengths of IR-emitters containing various amounts of cobalt oxide (CoO), magnesium oxide (MgO), and zirconia ($ZrO_2$) have been experimentally determined to be around 3 um, 5 um, and 10 um, respectively.

In addition, the present inventor also experimentally discovered that purposely using at least two IR-emitters with various peak wavelengths in a group could significantly increase the fuel activation effect on fuel, and thus dramatically improve engine performance.

As described above, the prior art failed to teach the combined use of a number of IR-emitters with specific peak wavelength and spectral luminance in 3-20 um wavelength range for maximizing improvement of hydrocarbon fuel combustion efficiency in engines.

Objects and Advantages

Accordingly, one object of this invention is to provide a device that can effectively increase combustion efficiency of hydrocarbon fuels in an internal combustion engine to enhance its performance for increased power, improved fuel economy, and reduced emissions.

Another object of the present invention is to provide a simple, easy-to-install, and maintenance-free fuel combustion efficiency enhancement device.

These objectives are achieved by an infrared fuel activation device comprising essentially at least two infrared emitting bodies, each with a specific peak wavelength and spectral luminance. The device can be mounted on the exterior or disposed in the interior of a fuel line of an engine to excite the hydrocarbon fuel before it enters the cylinders for combustion.

Other objects, features and advantages of the present invention will hereinafter become apparent to those skilled in the art from the following description.

DRAWING FIGURES

FIG. 1 shows a perspective view of one embodiment of the present invention with two separate infrared emitting bodies in partial-tubular form being mounted on a fuel line.

REFERENCE NUMERALS IN DRAWINGS

11 Infrared emitting body 1
12 Infrared emitting body 2
21 Attachment means
22 Fuel line

SUMMARY

In accordance with the present invention a fuel activating device and method consists of at least two infrared emitting bodies, each body being made of selective metal oxides to have specific peak wavelength and spectral luminance in 3-20 um wavelength spectrum. It can enhance fuel efficiency of internal combustion engines, resulting in better engine performance with increased power, improved fuel economy, and reduced emissions. The fuel activation device can be either mounted on the exterior or disposed in the interior of a fuel line of an engine to energize the fuel before it enters the cylinders for efficient combustion.

DETAILED DESCRIPTION OF THE INVENTION

It is well known that absorption of an infrared photon at a wavelength shorter than 20 um (micrometer) gives rise to bond stretching or bending vibration in hydrocarbon molecule. In fact, Organic Chemists have been using IR absorption spectral analysis (so-called "Infrared Correlation Charts") to identify unknown specimen for decades. Based on spectral absorption profile in 3-7 um (so-called "Functional Group" zone) and 7-20 um ("Signature" Zone) ranges the test specimen can be precisely identified. However, what people had long ignored was absorbing IR photons could increase kinetic energy of covalent bonds and thus cause molecule to vibrate. It not only changes dipole moment of hydrocarbon molecule, but also decreases activation barrier of the bond and increases reaction rate during combustion, as described in Quantum Mechanics.

The present inventor had reported favorable results on using the devices as described in U.S. Pat. No. 6,026,788 to excite fuel for enhanced engine performance. The net results were improved fuel combustion efficiency with increased torque/power, reduced fuel consumption, and lowered emissions. Nevertheless, the present inventor faced a limitation using such an IR Fuel Activator in heavy duty gasoline or diesel truck applications that require exciting a much larger flow of fuel substance instantly. After years of research, the present inventor had realized the use of a well-balanced infrared spectral luminance all through 3-20 um spectrum would be required for exciting all hydrocarbons in the fuels for such applications.

The present inventor further learned in literature search and confirmed in experiments that the peak wavelengths of cobalt oxide, magnesium oxide, and zirconia are around 3 um, 5 um and 10 um, respectively. Adding various weight percentages of such oxides to the oxide mixture as disclosed in U.S. Pat. No. 6,026,788 provides a means to manipulate peak wavelength and spectral luminance of the resultant IR-emitter.

In addition, the present inventor also found the pyroelectric property of tourmaline, one of the most complicated silicate minerals, could help increase thermal conversion efficiency of IR-emitter. Therefore, substituting a part of silicate with tourmaline in forming the IR-emitting body can significantly improve its overall infrared emissions in 3-20 um wavelength range. Several examples of the present invention were prepared accordingly for concept-demonstrating experiments.

FIG. 1 shows a perspective view of one embodiment of the present invention, in which two infrared emitting bodies, 11 and 12, are mounted on a fuel line, 22, of an engine. The two infrared emitting bodies may be secured with an attachment means, 21, to the fuel line. In this case it is a wrap tie. The infrared emitting body can take any shapes, forms, styles, patterns, and in any thickness, though partial-tubular shape is preferred for the ease of placing on the exterior of a fuel line in this embodiment.

In other embodiments the infrared emitting bodies can be disposed in the interior of a fuel line, embedded or coated on the inner wall, or being a part of the fuel line.

EXAMPLES

Three (3) infrared-emitting bodies were designed and devised for demonstration: Sample A contains 31 wt (weight) % silicate, 16% alumina, 39% ferric oxide, 5% chromic oxide, 4% cobalt oxide, and others; Sample B 41% silicate, 27% alumina, 15% zirconia, 9% magnesium oxide, 2% cobalt oxide and others; and Sample C 43% silicate, 19% alumina, 28% zirconia, 5% sodium monoxide, 3% potassium oxide and others. An SEM/EDS (scanning electron microscope with energy dispersive spectrometry) plot was run with each sample to obtain a quantitative analysis on the elemental composition of the oxide compounds. In lab, an infrared imaging camera with variable wavelength band filters was used to determine the spectral luminance for each IR-emitter. Combined use of two or three of these IR-emitters was proved to outperform the use of same number of IR-emitters of the same kind.

Scientific Verification Experimentation

The effect of the combined use of different IR-emitting bodies having specific spectral luminance was scientifically investigated in a Methane-Air Counter-flow Non-premix Laminar Diffusion Flame experiment. Counter-flow laminar flames are widely used in evaluation of chemical kinetic rates because they are one-dimensional and have a uniform strain rate. Counter-flow flames also allow the use of OPPDIF code to reveal chemical kinetics details with manageable computational times. Besides, the methane mechanism and the well-established thermochemical database can be used to predict and compare the measured concentrations of major species, such as $CH_4$, CO, $CO_2$, $H_2$, $C_2H_2$, $C_2H_4$, and NO.

The study had successfully demonstrated the IR-effect on influencing flame structure (i.e. distribution of species across the flame) with reduced pollutant (CO and NO) emissions. The fuel consumption rate was reduced by 8% with the IR-excitation from said IR-emitters working as a group. The data showed IR-excited methane produced 25% less peak CO and $CO_2$ emissions than regular methane. Meanwhile, the NO emission index for combustion of IR-excited methane is computed to be about 15% less than regular methane.

Beta-Site Vehicle Testing

The combined use of IR-emitters were tested by a voluntary trucking company at Indianapolis (Ind.) on their 2005 Kenworth T600A truck-trailers equipped with a 15 L Cummins ISX-475 heavy duty diesel engine. Four trucks participated in the test for 3 months. The results indicated a respective fuel economy improvement of 13.9%, 10.5%, and 11.0% for the three trucks with IR-emitters installed, while the fuel economy for the fourth truck, serving as a Control Truck with no IR-emitters installed, remained nearly unchanged.

Conclusion, Ramifications, and Scope

According to the present invention, an IR Fuel Activation device comprises at least two infrared emitting bodies, formed of separate compositions of IR emitting materials and thus emitting infrared at distinct peak wavelengths with specific spectral luminance in 3-20 um range, that can be either mounted on the exterior or disposed in the interior of a fuel line of an internal combustion engine for increased fuel combustion efficiency and improved engine performance.

The invention has been described above. Obviously, numerous modifications and variations of the present invention are possible in light of the above teachings. Such variations are not to be regarded as a departure from the spirit and scope of the invention and all such modifications as would be obvious to one skilled in the art are intended to be included within the scope of the following claims.

I claim:

1. A fuel activation device for exciting hydrocarbon fuel of an internal combustion engine and for thereby achieving efficient combustion of the fuel in the engine, said engine including a fuel line, said device comprising at least two separate infrared emitting bodies disposed on said fuel line whereby fuel used for the engine passes adjacent or in contact with the emitting bodies, wherein a first infrared emitting body includes a first composition of oxides and a second infrared emitting body includes a second composition of oxides, wherein each composition includes one or more oxides selected from the group consisting of zirconium oxide, cobalt oxide, titanium oxide, and magnesium oxide, wherein at least one of the selected oxide, for each composition, is at least 2 weight %, and wherein the first composition is selected to provide a first specific peak wavelength and spectral luminance in the range of 3 to 20 um and the second composition is selected to provide a second and different specific peak wavelength and spectral luminance in the range of 3 to 20 um.

2. A device according to claim 1 wherein the oxides are selected from the oxides of Groups I, II, III, or IV elements or transition elements in Periodic Table, or a mixture of said oxides.

3. A device according to claim 1 wherein one infrared emitting body contains at least 2 weight % zirconium oxide.

4. A device according to claim 1 wherein one infrared emitting body contains at least 2 weight % cobalt oxide.

5. A device according to claim 1 wherein one infrared emitting body contains at least 2 weight % magnesium oxide.

6. A device according to claim 2 wherein a part of oxides is replaced with tourmaline.

7. A device according to claim 1 wherein the infrared emitting bodies are mounted on the exterior of said fuel line.

8. A device according to claim 1 wherein the infrared emitting bodies are disposed in the interior of said fuel line.

9. A device according to claim 1 wherein the infrared emitting bodies are a part of said fuel line.

10. A method for activating hydrocarbon fuel used for an internal combustion engine and for thereby achieving efficient combustion of the fuel in the engine, the method comprising the steps of:

providing at least two separate infrared emitting bodies, wherein a first infrared emitting body includes a first composition of oxides and a second infrared emitting body includes a second composition of oxides, wherein each composition includes one or more oxides selected from the group consisting of zirconium oxide, cobalt oxide, titanium oxide, and magnesium oxide, wherein at least one of the selected oxide, for each composition, is at least 2 weight % and wherein the first composition is selected to provide a first specific peak wavelength and spectral luminance in the range of 3 to 20 um and the second composition is selected to provide a second and different specific peak wavelength and spectral luminance in the range of 3 to 20 um, and disposing said bodies adjacent to or in contact with said fuel.

11. The device according to claim 1 wherein the selected oxide are selected from the group consisting of approximately 3 weight % cobalt oxide, 10 weight % zirconia and 5 weight % magnesium oxide.

12. The device according to claim 1 wherein the at least two separate infrared emitting bodies are selected from the group of infrared emitting bodies consisting of a first infrared emitting body having an oxide composition including approximately 4 weight % cobalt oxide, a second infrared emitting body having an oxide composition including approximately 2 weight % cobalt oxide, approximately 15 weight % zirconia and approximately 9 weight % magnesium oxide and a third infrared emitting body having an oxide composition including approximately 28 weight % zirconia.

13. The device according to claim 1 wherein the infrared emitting bodies are part of a fuel delivery system coupled to the engine via the fuel line.

* * * * *